US006505490B2

(12) United States Patent
Hodjat et al.

(10) Patent No.: US 6,505,490 B2
(45) Date of Patent: Jan. 14, 2003

(54) METHOD OF FORMING A SHEET METAL CUP WITHOUT A MANDREL

(75) Inventors: Yahya Hodjat, Oxford, MI (US); John P. Roes, Strathroy (CA)

(73) Assignee: The Gates Corporation, Denver, CO (US)

( * ) Notice: Subject to any disclaimer, the term of this patent is extended or adjusted under 35 U.S.C. 154(b) by 0 days.

(21) Appl. No.: 09/797,548

(22) Filed: Feb. 28, 2001

(65) Prior Publication Data

US 2002/0116972 A1 Aug. 29, 2002

(51) Int. Cl.[7] ..... B21D 22/00
(52) U.S. Cl. ..... 72/84; 72/80
(58) Field of Search ..... 72/82, 83, 84, 72/85, 80, 81, 68; 29/892.3

(56) References Cited

U.S. PATENT DOCUMENTS

| | | | | |
|---|---|---|---|---|
| 3,910,423 A | | 10/1975 | Killian et al. | 214/1 BB |
| 3,991,598 A | | 11/1976 | Kraft | 72/83 |
| 4,023,250 A | | 5/1977 | Sproul et al. | 29/159 R |
| 4,289,007 A | | 9/1981 | Kraft | 72/58 |
| 4,404,829 A | | 9/1983 | Dorakovski | 72/84 |
| 5,355,705 A | * | 10/1994 | Schulze et al. | 72/83 |
| 5,428,980 A | | 7/1995 | Iidaka | 72/83 |
| 5,640,867 A | * | 6/1997 | Massee | 72/84 |
| 5,806,358 A | * | 9/1998 | Rolf | 72/68 |
| 5,947,853 A | | 9/1999 | Hodjat et al. | 474/166 |
| 5,951,422 A | | 9/1999 | Roes et al. | 474/94 |

FOREIGN PATENT DOCUMENTS

| | | | | |
|---|---|---|---|---|
| DE | 2927506 | * | 1/1981 | 72/83 |
| DE | 285561 | * | 12/1990 | 72/84 |
| JP | 58-205623 | * | 11/1983 | 72/83 |
| JP | 63-97324 | * | 4/1988 | 29/892.3 |
| JP | 63-140732 | * | 6/1988 | 29/892.3 |

* cited by examiner

*Primary Examiner*—Ed Tolan
(74) *Attorney, Agent, or Firm*—J. A. Thurnau, Esq.; C. H. Castleman, Esq.; S. G. Austin, Esq.

(57) ABSTRACT

The invention comprises a method of forming a sheet metal cup without using a mandrel. A cup shaped blank is first produced having a relief on a rim or outer circumference. The blank is clamped in the spinning machine. The relief controls and facilitates the bending process, creating a uniform curve at a predetermined bending point. During the rolling process, a forming roller is engaged with rim, and is moved progressively parallel with an axis of rotation. As the forming roller moves, the rim is progressively bent from an orientation normal to an axis of rotation to a position parallel to the axis of rotation. The fully formed rim can then be punched to accommodate a bearing or shaft. This allows a small radius pulley to be formed without use of a mandrel.

11 Claims, 2 Drawing Sheets

METHOD OF FORMING A SHEET METAL CUP WITHOUT A MANDREL

FIELD OF THE INVENTION

The invention relates to a method of forming a sheet metal cup, and more particularly to a method of forming a sheet metal cup without using a mandrel.

BACKGROUND OF THE INVENTION

Metal cups, used as pulleys and idlers, may be formed by spinning or metal forming a flat, circular metal blank or a metal blank with a hub. The flat blank is placed in a spinning machine, where it is generally held in place by clamping chucks. A central mandrel or tailstock is pressed against a center of the blank. A mandrel is also put in an axial position to support the blank across its entire width. The blank is spun while forming rollers are moved radially about the blank, while it is supported by the mandrel. As the forming rollers move inward, metal may be collected and accumulated against the central mandrel, forming a hub. The forming process imposes significant side loads on the central mandrel, thereby requiring it and the associated machinery to have a thickness sufficient to resist deformation.

Representative of the art is U.S. Pat. No. 5,947,853 (1999) to Hodjat et al., which discloses a pulley having an integral hub that is spun formed of a flat disc of sheet metal. As the metal is gathered toward the pulley hub across a supporting mandrel, a central mandrel controls the location and size of a hub.

Also representative of the art is U.S. Pat. No. 4,404,829 (1983) to Dorakovski which discloses a process of manufacturing a pulley using a cup-shaped blank. The cup shaped blank is clamped between a feeding plunger and a tail stock assembly. The tailstock fully engages and supports the blank as it is formed into a ribbed pulley.

Use of a sufficiently thick mandrel in the prior art imposes restrictions on the blank cup size. For example, to make automotive pulleys with a commonly used bearing that has an outside diameter of 40 mm, the pulley diameter cannot be less than about 64 mm. This is because the mandrel thickness cannot be less than 8 mm, otherwise it will break during the forming process.

What is needed is a method of forming a sheet metal cup without using a mandrel. What is needed is a method of forming a sheet metal cup without using a mandrel for forming a small radius cup. The present invention meets these needs.

SUMMARY OF THE INVENTION

The primary aspect of the invention is to provide a method of forming a sheet metal cup without using a mandrel.

Another aspect of the invention is to provide a method of forming a sheet metal cup without using a mandrel for forming a small radius cup.

Other aspects of the invention will be pointed out or made obvious by the following description of the invention and the accompanying drawings.

The invention comprises a method of forming a sheet metal cup without using a mandrel. A cup shaped blank is first produced having a relief on a rim outer circumference.: The blank is clamped in the spinning machine. The relief controls and facilitates the bending process, creating a uniform curve at a predetermined bending point. During the rolling process, a forming roller is engaged with rim, and is moved progressively parallel with an axis of rotation. As the forming roller moves, the rim is progressively bent from an orientation normal to an axis of rotation to a position parallel to the axis of rotation. The fully formed rim can then be punched, if necessary, to accommodate a bearing or shaft. This allows a small radius cup, which can then be used as a pulley or idler, to be formed without use of a mandrel.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 1:
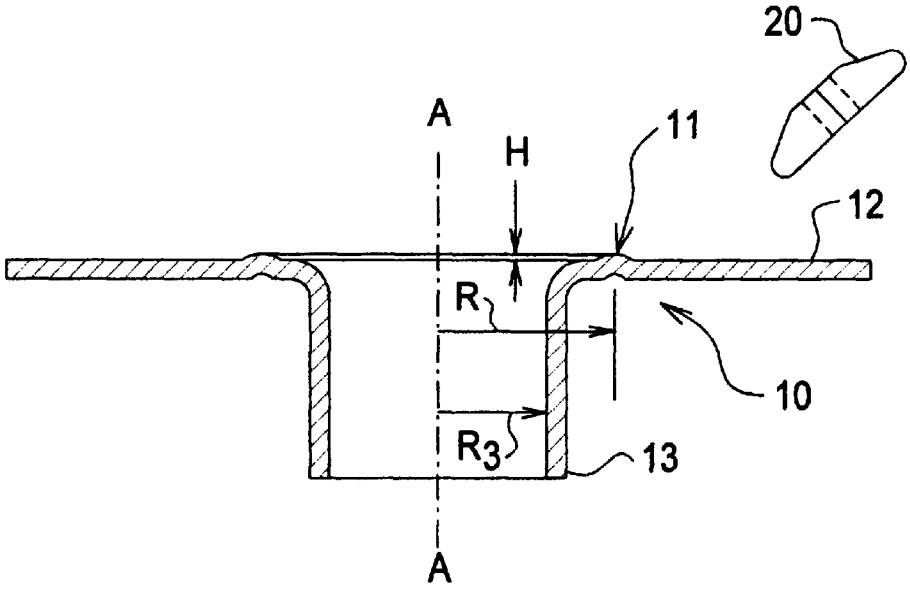
FIG. 1 is a half cross-sectional view of a blank.

FIG. 1 is a half cross-sectional view of a blank. Cup-shaped blank 10 comprises a rim 12 and hub 13. Blank 10 may be given its initial form by stamping. Hub 13 also describes a central hole having a radius R3 about a central axis of rotation A—A. The central hole may receive a shaft or a bearing(not shown).

Rim 12 further comprises a relief 11. Relief 11 has a height H above a surface of rim 12. Height H is in the range of 0.05 mm to 2 mm. Relief 11 projects in a direction opposite that of a direction of movement of a forming roller. Relief 11 is located at a radius R from axis A—A and it encircles hub 13. Relief 11 is formed in the blank prior to the rolling process to properly control a bend location in rim 12 as described herein. As such, it provides a predictable location for the bend to occur during the rolling process, resulting in an outer surface concentric about an axis of rotation as describing herein.

Figure 2:
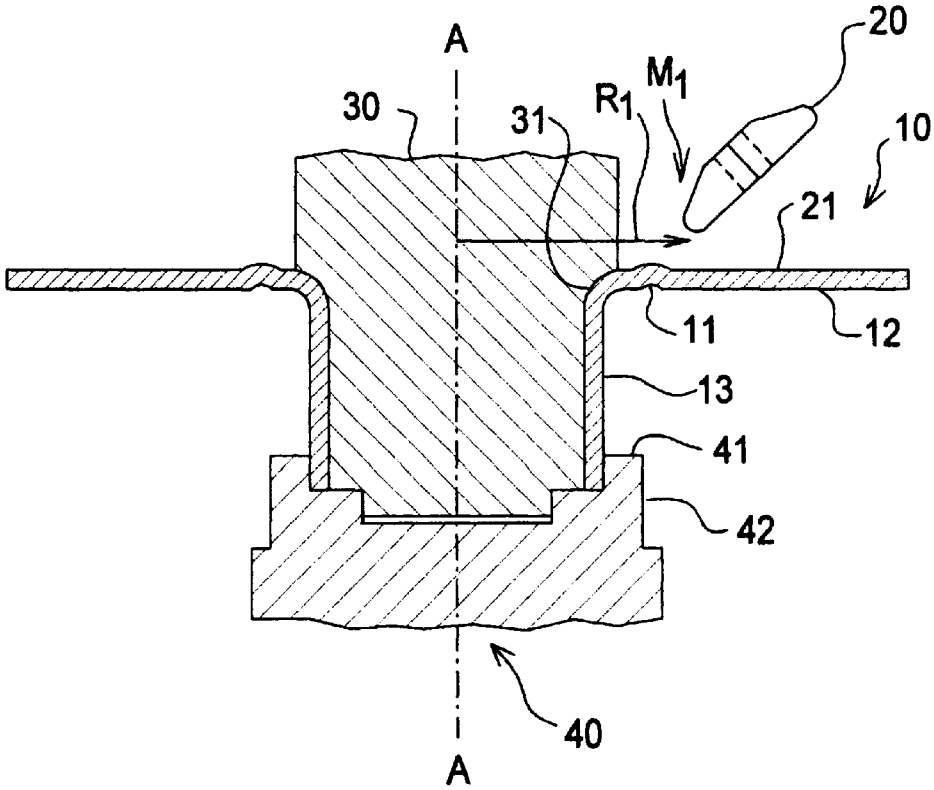
FIG. 2 is a half cross-sectional view of the blank in the forming machine.

FIG. 2 is a half cross-sectional view of the blank in the forming machine. Blank 10 is clamped between inner tooling 30 and outer tooling 40. Hub 13 is held between the respective tooling parts, each properly shaped for receiving those portions of the blank. Tang 41 radially holds hub 13 against tooling 30. Inner tooling 30 may extend through a central hole in the hub to support the hub during the rolling process, or bear upon a shoulder 31 of hub 13.

During forming, forming roller 20 is brought into an initial position adjacent to the rim. It is set at a radius R1 from axis A—A depending upon the desired final radius R3 of outer surface 21. R1 is greater than radius R. The roller is then engaged with an outer surface 21 of blank 10. Forming roller 20 is moved substantially parallel to central axis A—A in direction M1 as described in FIGS. 3 and 4.

Figure 3:
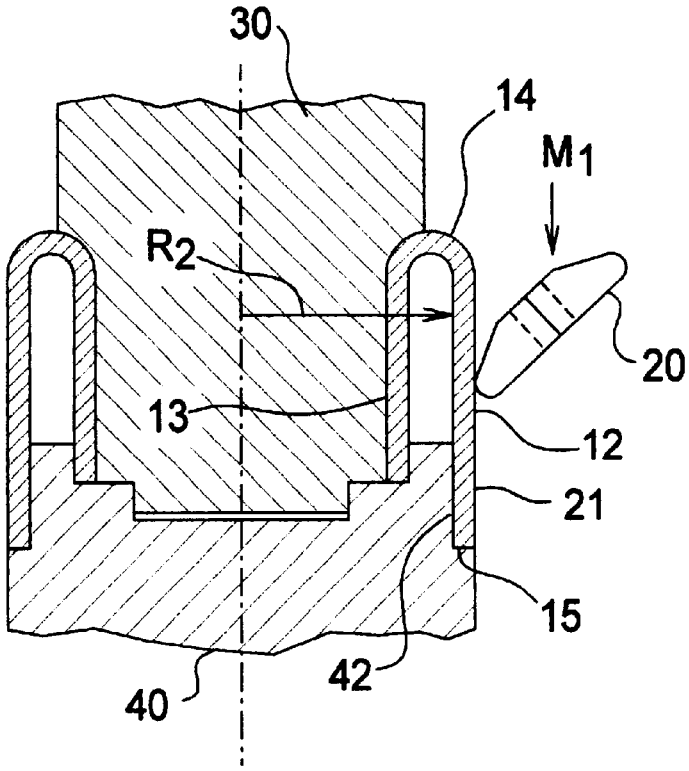
FIG. 3 is a half cross-sectional view of the blank being formed on the forming machine.

FIG. 3 is a half cross-sectional view of the blank being formed in the forming machine. Forming roller 20 moves progressively in direction $M_1$. Rim 12 initially bends at relief 11. Rim 12 of the blank is progressively formed until rim 12 is parallel to the axis of rotation A—A, at which point it comes into contact with surface 42 of outer tooling 40. Surface 42 is concentric with rim 12 upon completion of the forming process. Smooth radius bend 14 is formed at the location of relief 11.

The location of relief 11 at radius R determines a total radius R2 of the completely formed cup. Relief 11 may be sized, by varying height H, and located, by varying radius R, according to the needs of a user, to produce a radius R2 having a desired value. Radius R of the relief and the engagement radius of the forming roller R1 combine to determine the total radius from axis A—A to an outer surface of the cup 21. It should be noted that surface 42 acts to receive the formed rim 12 at a final predetermined radius, and does not operate as a mandrel to support rim 12 during the forming process. Consequently, the metal cup is fully formed without a mandrel.

Surface 15 of the formed cup also describes a hole having a predetermined diameter, or it can be punched out to a desired diameter.

Figure 4:
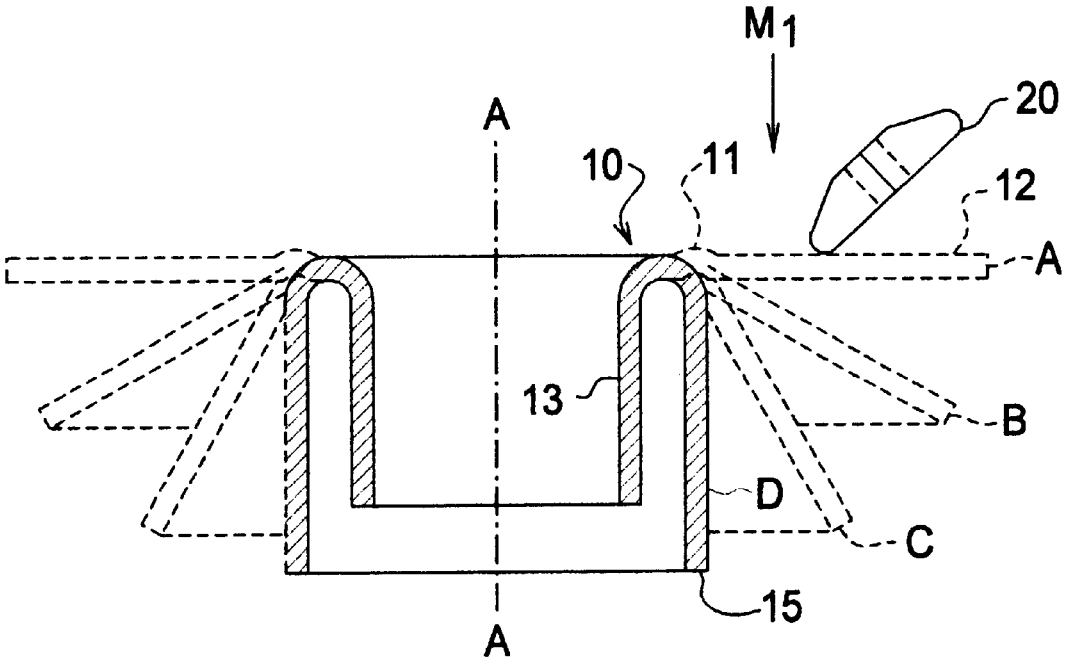
FIG. 4 is a half cross-sectional view of the progression of forming a pulley in the forming machine.

FIG. 4 is a half cross-sectional view of the progression of forming the cup in the forming machine. Rim 12 is initially in position A, as shown in FIG. 2. As forming roller 20 engages rim 12 and moves in direction $M_1$, rim 12 is rolled progressively to position B and then to position C. At the completion of the rolling process rim 12 is in a final position D, as also shown and described in FIG. 3. Final position D is the position wherein rim 12 is parallel to an axis of rotation A—A of the cup and is adjacent to hub 13.

By use of the disclosed process, cups may be produced wherein radius R2 is only slightly greater than radius R3. This may be in the range of R3 being equal to 1.05 to 3 times the value of R2; or put another way, R3=1.05×(R2) to R3=3×(R2). As. one can see, this process results in an economically produced, small diameter metal cup.

The cup produced by the process described herein may be used in any application as a pulley, idler, or any other use that requires a circular rotating element.

Although a single form of the invention has been described herein, it will be obvious to those skilled in the art that variations may be made in the construction and relation of parts without departing from the spirit and scope of the invention described herein.

We claim:

1. A method of forming a cup comprising the steps of:

forming a relief at a radius R circumferentially about the hub whereby a bend is initiated at the relief by a forming roller;

clamping a blank having a rim and a hub in a tool, the rim and the hub being substantially non-colinear;

rotating the blank;

engaging the a forming roller at a radius R1 against the rim;

forming the rim by progressively moving the forming roller parallel to an axis of rotation of the blank until the rim is substantially parallel to an axis of rotation of the blank; and stopping the forming roller at a predetermined point.

2. The method as in claim 1, wherein the step of clamping the blank to the tool further comprises the steps of:

forming the hub having a radius R3;

clamping the blank to the tool at the hub; and supporting the rim upon completion with a tool surface concentric with the rim.

3. The method as in claim 2, wherein the step of forming the rim by progressively moving the forming roller parallel to an axis of rotation of the blank until the rim is substantially parallel to an axis of rotation of the blank further comprises the step of:

forming the rim to a position substantially adjacent the hub.

4. The method as in claim 3, wherein the step of forming a relief at a radius R about a circumference of the hub whereby a bend is initiated at the relief by a forming roller further comprises the step of:

forming the relief having a height H above a surface of the rim.

5. The method as in claim 4, wherein the step of forming the rim by progressively moving the forming roller parallel to an axis of rotation of the blank until the rim is substantially parallel to an axis of rotation of the blank further comprises the step of:

forming the rim to a position having a radius R2; and radius R2 is greater than radius R3.

6. The method as in claim 5, wherein R1 is greater than R.

7. The method as in claim 6, wherein the step of supporting the rolled rim: with a tool surface coplanar with the rim comprises the step of:

placing said tool surface at a radius equal to R2.

8. The method as in claim 7, wherein height H is in the range of 0.05 mm to 2 mm.

9. The method as in claim 8, wherein radius R2 is in the range of 1.05×(R3) to 5×(R3).

10. A method of forming comprising:

forming a blank having a rim and a hub and a relief, the relief having a height above a rim surface and being circumferentially disposed on the rim to control a bend location;

clamping the hub in a tool;

rotating the blank;

engaging a forming roller against the rim; and bending the rim at the relief by moving the forming roller parallel to an axis of rotation of the blank.

11. The method in claim 10 further comprising:

moving the forming roller until the rim is substantially parallel to an axis of rotation of the blank.

* * * * *